United States Patent [19]

Petrushevsky et al.

[11] 3,960,045

[45] June 1, 1976

[54] REGISTER SWITCHING DEVICE FOR A REED MUSICAL INSTRUMENT

[76] Inventors: Georgy Sergeevich Petrushevsky; Valentina Sergeevna Petrushevskava, both of Bulvar Karla Marxa, 13/3, kv. 74, Kishinev, U.S.S.R.

[22] Filed: Nov. 20, 1974

[21] Appl. No.: 525,652

[52] U.S. Cl. ..... 84/376 SM
[51] Int. Cl.[2] ..... G10D 11/00
[58] Field of Search ..... 84/376 SM

[56] References Cited

UNITED STATES PATENTS

| | | | |
|---|---|---|---|
| 1,693,616 | 12/1928 | Nardone | 84/376 SM |
| 2,208,375 | 7/1940 | Lindeberg | 84/376 SM |
| 2,385,286 | 9/1945 | Kostka | 84/376 SM |

FOREIGN PATENTS OR APPLICATIONS

| | | | |
|---|---|---|---|
| 493,931 | 5/1954 | Italy | 84/376 |
| 513,355 | 2/1955 | Italy | 84/376 |

*Primary Examiner*—Lawrence R. Franklin
*Attorney, Agent, or Firm*—Haseltine, Lake & Waters

[57] ABSTRACT

A register switching device in which each key of the proposed device is finger-pressed and carrier a pusher and a pivoted lever. The register switching keys are mounted on a common axle with each key adapted to be set in two positions. In one position, the pusher interacts with a moderator plate shifting lever. In the other position, the pivoted lever is arranged close to the moderator plate shifting lever and enters into engagement with a plate movably arranged along the key axle. As the plate is shifted by an auxiliary chin key, it brings the pivoted lever into engagement with the moderator plate shifting lever, thereby causing register switching.

9 Claims, 2 Drawing Figures

REGISTER SWITCHING DEVICE FOR A REED MUSICAL INSTRUMENT

Figure 1:
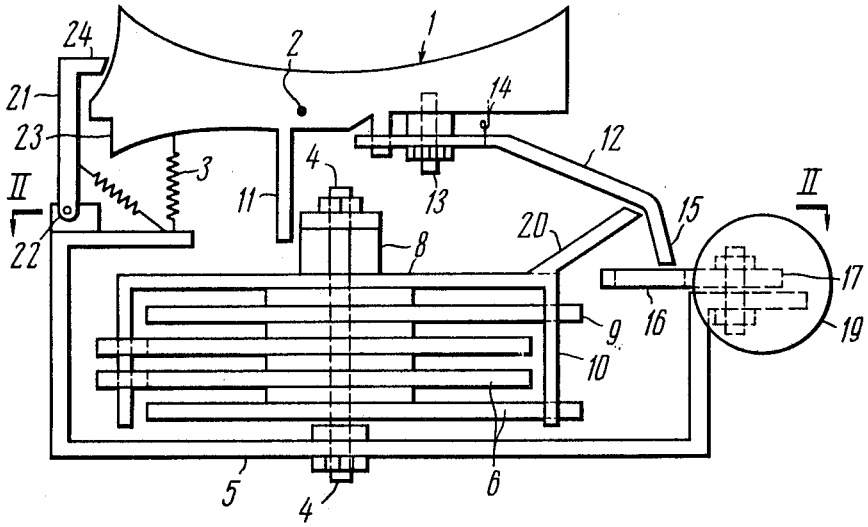

The present invention relates to an improvement in register switching devices of reed musical instruments. The invention may find application in accordions, harmonicas, and the like.

There is known at present a register switching device for reed musical instruments, which comprises spring-loaded finger keys for register switching during rests in the music. The finger keys interact, by means of a pusher, with register plate levers which are mounted on axles secured on a frame.

The register plates shift, by means of the levers, the moderator plates in the sounding board of the instrument. This results in opening or closing the holes in the resonators with voice plates. For greater convenience of register switching, especially when the player has all his fingers on the keyboard and cannot use them to switch the register, several register switching keys of the most commonly used registers are arranged on the upper wall of the instrument's sounding board or in any other convenient place so that the musician is able to switch to a required register without interrupting the playing.

In accordions, such register switches are arranged behind the sounding board. The register key is elongated, arranged along the sounding board and pressed by the player's palm. In many cases the register switch key is mounted on the upper wall of the sounding board of an accordion and is pressed by the player's chin. Such additional register switches are commonly referred to as chin or tutti switches. Some accordions and Russian accordions are provided with several register switching keys of this type, each corresponding to one of such most often used registers such as the "orchestra", "organ", "accordion", and "bassoon"; this, however, substantially raises the price of the instrument.

Yet to have more than five chin register switches and more than a few palm register switches would make the instrument too complicated and would cause great inconvenience for the performer. At the same time, there may be over a score of different register combinations in polyphonic musical instruments. Thus, the known register switching devices do not make full use of the expressive potentialities of reed instruments.

It is an object of the present invention to provide a register switching device for reed musical instrumensts, which would make for a fuller use of the instruments' potentialities.

The above and other objects of the present invention are attained in a register switching device for reed musical instruments, said device having spring-loaded, finger-actuated register switching keys mounted on an axle, each said key being provided with a pusher acting on a register strip shifting lever of moderator plates, and an auxiliary tutti switch, each said key being provided, according to the invention, with a lever adapted for pivoting in the plane coinciding with that of the register strip shifting lever, each key being adapted to be set in two positions in one of which the key's pusher interacts with the register strip shifting lever, whereas in the other position, the pivoting lever is set in the initial position to ensure the possibility of further interaction with the register strip shifting lever; the above-mentioned and other objects of the present invention are also attained due to the fact that the auxiliary tutti switch is a strip movably arranged along the axle of the register switch keys, which strip is adapted for engagement with the pivoting lever, as the latter is in its initial state, to bring said lever into engagement with the register strip shifting lever due to the shifting of the additional switch's strip.

The proposed device is advantageous in that due to the presence of the pivoting lever, the double-position key, and the specially designed auxiliary switch, it becomes possible to programmably control register switching when playing a reed instrument. This makes it possible to select, with the aid of said switch, any desired register without interrupting the playing, which is especially important in view of the fact that known devices designed for register switching without interrupting the playing only make it possible to select a strictly limited number of registers, said limitation being due to the instrument's design. Thus, instead of using only 4 or 5 preselected registers, the proposed device provides for using all the instrument's registers. The simplicity of its design allows it to be employed not only in specially manufactured concert instruments, but also in ordinary, produced instruments.

In order to ensure engagement between the pivoting levers and the auxiliary switch strip, said strip is provided with a number of holes, which number corresponds to that of the pivoting levers, each hole being arranged opposite the respective lever.

According to another embodiment of the present invention, the auxiliary switch strip may have protrusions in a number corresponding to that of the pivoting levers, each of said protrusions being arranged opposite the respective lever and intended to interact with the arm of the lever in its initial position, thereby bringing the strip and the lever into engagement.

It is expedient that in order to bring the strip back to the initial position, said strip be spring-loaded in the axial direction.

In order to keep the register switching key in a desired position, provision is made for a locking means to keep the key in place as its lever is set in the initial position.

Such a locking means may be constructed in the form of a strip secured on a frame with the aid of an axle along the entire length of the finger-actuated keys and having a protrusion facing said keys, each of said keys having a slot to receive said protrusion, as the pivoting lever is set in the initial position.

Figure 2:
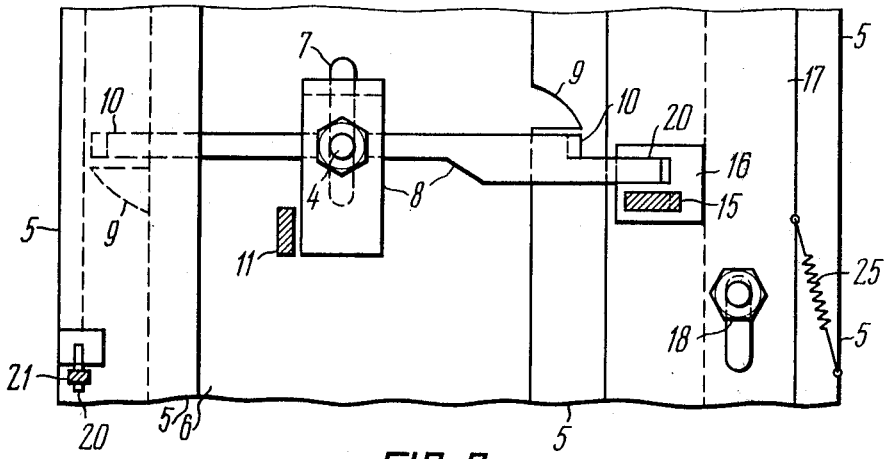

The invention will be better understood from the following description of an exemplary embodiment thereof taken in conjunction with the accompanying drawings, wherein:

FIG. 1 is a sectional view of a register switch key of an accordion with a respective register unit and an auxiliary switch; and FIG. 2 is a section taken along line II—II in FIG. 1.

The proposed register switching device comprises a plurality of identical finger-actuated register switching keys, each of said keys corresponding to a preselected combination of register strips that shift moderator plates.

In order to simplify the disclosure, FIGS. 1 and 2 show only one such key with a respective register combination which in the present case is the organ combination.

Referring now to the attached drawings, a register switching key 1 of the proposed register switching device is rotatably mounted on an axle 2 and is spring-loaded by a tension spring 3. Mounted on an axle 4 secured in a frame 5 are register strips 6 provided with guide slots 7 (FIG. 2). The number of the register strips 6 depends upon the number of voices of the instrument in the present case there are four such strips, which number corresponds to the four voices of the instrument. The shifting of the register strips 6 is effected by a lever 8. On the lateral side of each strip 6 there is a protrusion 9. In the case under consideration the protrusions 9 in the extreme register strips 6 are intended for shifting the register strips 6 to actuate moderator plates which open the holes in the sounding board of the instrument. The protrusions 9 in the middle register strips are intended for shifting the register strips 6 to bring back the moderator plates that close the holes in the instrument's sounding board.

The moderator plates are not shown in FIGS. 1 and 2 and these are entirely conventional. These may be coupled to the register strips 6 in any known manner, for example, as in the "Delicia" accordion manufactured by the Harmonica Company.

The lever 8 is rotatably mounted on the axle 4, its ends 10 interacting with the protrusions 9 as it is pressed by a pusher 11 rigidly mounted on the key 1. The key 1 is provided with a lever 12 rotatably mounted on an axle 13 in the plane which coincides with the plane of movement of the lever 8. The lever 12 is spring-loaded by a spring 14 for the purpose of stabilizing the position of lever 12. An arm 15 of the lever 12 is opposite a hole 16 provided in a strip 17 mounted on the frame 5 and adapted to move in slots 18 (FIG. 2) in the direction of the key axle 2. As in the known instrument designs, the strip 17 is shifted by means of a so-called chin key 19 arranged on the outer surface of the accordion's body. The key 1 is adapted to be set in two positions. In one of these positions, the pusher 11 interacts with the lever 8 for shifting the register strips 6; in the other position of the key 1, the pivoting lever 12 is set in an initial position, which makes possible its subsequent interaction with the lever 8 for shifting the register plates 6. In order to simplify the design, the lever 8 has a protrusion 20 (FIG. 2) directed towards the pivoting lever 12. As the lever 12 is set in the initial position, its arm 15 is found in immediate proximity to said protrusion 20.

In order to lock the pivoting lever 12 in its initial position, provision is made for a locking means. Said locking means comprises a strip 21 which is L-shaped in section as shown in FIG. 1. Said strip is arranged along the entire length of the register switching keys and is mounted on an axle 22. Each key 1 has a slot 23 in its lower portion. As the key 1 is pressed on the side of the lever 12, the slot 23 engages a protrusion 24 of the strip 21, and the key 1 is held in the position corresponding to the initial position of the lever 12. As any other key is actuated, the strip 21 turns around the axle 22 and leaves the slot 23, which makes it possible to effect re-switching of the keys.

The operation of the proposed device in the course of performance will next be given.

The performer presses the key 1 on the side of the pusher 11, thereby setting the desired register. The pusher 11 acts upon the lever 8 whose ends 10 interact with the protrusions 9 which shift the register strips 6. In the case under review, the extreme register strips 6 actuate the moderator plates which open the holes in the sounding board; the middle register strips bring out of action the moderator strips that close the holes in the sounding board. The pressing of the same side of any other key brings into play another register combination, as is the case in known accordion designs.

Suppose now the performer desires the organ register which is shown in FIG. 1. The performer sets the desired register by pressing the key 1 on the side where the pivoting lever 12 is located.

By turning around the axle 2, the key 1 sets the pivoting lever 12 in the initial position, which ensures subsequent interaction of said lever with the lever 8 for shifting the register strips 6. As this takes place, the protrusion 24 of the strip 21 of the locking means is received in the slot 23 and locks the key 1 in the predetermined initial position, whereas the arm 15 of the pivoting lever enters the hole 16 in the strip 17 to find itself opposite the protrusion 20 of the lever 8, in the same plane therewith. Having set the key 1 in the initial position, the performer waits for the right moment to press the key 19. As the key 19 is pressed, the strip 17 moves along the guide slot 18 and catches the arm 15 of the lever 12 found at this moment in the hole 16. Being at the same level as the protrusion 20, the lever 12 pushes protrusion 20, and the lever 8 shifts the register strips 6. After switching off the register, the strip 17 resumes its initial position under the action of a spring 25. When the performer desires any other register, he sets it by means of the respective register key. The protrusion 24 of the strip 21 of the locking means is then moved aside by the key being pressed by the performer, which enables the previously pressed key 1 to unlock itself. The key 1 of the other register combination is locked in place the same way as has been described above and sets the lever in the initial position, which ensures switching to the desired register by pressing the key 19.

The present disclosure has dealt in detail with the register switch which provides for a preliminary setting of one register. In order to ensure a preliminary setting of several registers, provision should be made for additional register keys, each furnished with a respective pivoting lever. The number of chin keys should correspond to that of the additional register keys.

What is claimed is:

1. A register switching device for a reed musical instrument, said register switching device comprising a pivotal finger-actuated register key adapted to be set in first and second positions, a first pivotable lever, displaceable register strips positioned for engagement by said lever for movement thereby for control of the register of the musical instrument, said key including a pusher positioned to pivot said lever when the key is moved into said first position, a second lever displaceably mounted on said key and movable therewith as said key is pivotably moved, said second lever being in an initial position operatively juxtaposed with said first lever when said key is in said second position, an auxiliary key movable by an operator between operative and inoperative positions, said auxiliary key being positioned to displace said second lever as the auxiliary key moves from its inoperative to its operative position and when the second lever is in said initial position, said second lever under the action of the displacement thereof causing said first lever to pivotably move and displace said register strips.

2. A register switching device as claimed in claim 1 wherein said auxiliary key comprises a strip supported for movement between said operative and inoperative positions along the direction of the pivot axis of said register key.

3. A register switching device as claimed in claim 2 wherein said strip has a hole for receiving said second lever in said initial position thereof.

4. A register switching device as claimed in claim 2 comprising spring means acting on said strip for urging the same to said inoperative position.

5. A register switching device as claimed in claim 1 comprising locking means for releasably locking the register key in said second position whereupon said second lever is in said initial position.

6. A register switching device as claimed in claim 5 wherein said locking means comprises a strip adjacent said register key, said key having a slot, said strip including a projection engagable in said slot when the register key is in said second position.

7. A register switching device as claimed in claim 1 comprising a spring means acting on said second lever for opposing movement thereof under the action of said auxiliary key.

8. A register switching device as claimed in claim 7 wherein said second lever is pivotably mounted on said register key.

9. A register switching device as claimed in claim 1 comprising spring means acting on said register key for opposing movement thereof to said second position.

* * * * *